US010267315B2

(12) United States Patent
Chalmers et al.

(10) Patent No.: US 10,267,315 B2
(45) Date of Patent: Apr. 23, 2019

(54) CRYOGENIC SUBMERGED PUMP FOR LNG, LIGHT HYDROCARBON AND OTHER ELECTRICALLY NON-CONDUCTING AND NON-CORROSIVE FLUIDS

(71) Applicant: ACD, LLC, Santa Ana, CA (US)

(72) Inventors: Dennis W. Chalmers, Lake Forest, CA (US); Mina Botrous, La Habra, CA (US); Mugdha Dokhale, Maharashtra (IN); Elidio Ruiz, Commerce, CA (US); Mark Geipel, Laguna Niguel, CA (US)

(73) Assignee: ACD, LLC, Santa Ana, CA (US)

( * ) Notice: Subject to any disclaimer, the term of this patent is extended or adjusted under 35 U.S.C. 154(b) by 522 days.

(21) Appl. No.: 14/555,470

(22) Filed: Nov. 26, 2014

(65) Prior Publication Data

US 2015/0143822 A1 May 28, 2015

Related U.S. Application Data

(60) Provisional application No. 61/910,070, filed on Nov. 28, 2013, provisional application No. 62/058,795, filed on Oct. 2, 2014.

(51) Int. Cl.
*F04D 13/08* (2006.01)
*F04D 13/06* (2006.01)
(Continued)

(52) U.S. Cl.
CPC ..... *F04D 13/086* (2013.01); *F04B 15/08* (2013.01); *F04D 1/06* (2013.01); *F04D 13/0633* (2013.01);
(Continued)

(58) Field of Classification Search
CPC .... F04D 13/086; F04D 13/0633; F04B 15/08; F04B 2015/081; H02K 1/27; H02K 1/28; H02K 15/03
See application file for complete search history.

(56) References Cited

U.S. PATENT DOCUMENTS 3,369,715 A * 2/1968 Carter ..... F04D 9/00 222/333
3,494,291 A * 2/1970 Carter, Jr. ..... F16C 33/3831 415/110
(Continued)

FOREIGN PATENT DOCUMENTS

GB 2129494 A 5/1984

*Primary Examiner* — Charles G Freay
(74) *Attorney, Agent, or Firm* — Hackler Daghighian Martino & Novak

(57) ABSTRACT

A cryogenic submerged multi-stage pump assembly includes a vertically oriented pump shaft. A permanent magnet electrical motor includes a rotor attached to the pump shaft and a stator disposed about the rotor. A first-stage impeller assembly includes a first impeller attached to the pump shaft, the first impeller configured to move a cryogenic fluid from a first impeller inlet to a first impeller outlet when the pump shaft is rotated by the electric motor. A second-stage impeller assembly includes a second impeller attached to the pump shaft, the second impeller configured to move the cryogenic fluid from a first impeller housing to a second impeller inlet and then to a second impeller outlet when the pump shaft is rotated by the electric motor. The first and a second impeller housing are disposed about the first and second impellers and configured to channel the cryogenic fluid.

32 Claims, 11 Drawing Sheets

(51) Int. Cl.
*F04B 15/08* (2006.01)
*F04D 1/06* (2006.01)
*F04D 29/58* (2006.01)

(52) U.S. Cl.
CPC .... *F04D 29/5806* (2013.01); *F04B 2015/081* (2013.01)

(56) References Cited

U.S. PATENT DOCUMENTS 3,764,236 A * 10/1973 Carter ..... F04D 1/06 415/104
3,918,852 A * 11/1975 Carter ..... F04D 7/06 415/143
3,981,628 A * 9/1976 Carter ..... F04D 9/007 415/147
4,433,261 A * 2/1984 Nashiki ..... H02K 1/278 310/156.28
4,506,181 A 3/1985 Jones et al.
4,549,341 A * 10/1985 Kasabian ..... H02K 1/278 29/598
5,808,392 A * 9/1998 Sakai ..... H02K 1/278 310/156.07
5,923,111 A * 7/1999 Eno ..... E21B 43/128 310/153
6,167,724 B1 * 1/2001 Pozivil ..... F04D 1/10 417/251
6,183,219 B1 2/2001 Nguyen et al.
6,225,719 B1 5/2001 Hallundbaek
6,255,752 B1 * 7/2001 Werner ..... F04D 29/041 310/90.5
8,397,506 B1 * 3/2013 Wright ..... F01K 7/32 415/110
2009/0121571 A1 * 5/2009 Onuma ..... F04D 29/058 310/90.5
2011/0089782 A1 * 4/2011 Jeung ..... H02K 1/278 310/156.46
2013/0216405 A1 * 8/2013 Johchi ..... F04B 15/08 417/373
2013/0221784 A1 * 8/2013 Kori ..... H02K 1/27 310/90
2014/0300234 A1 * 10/2014 Bradfield ..... H02K 21/044 310/156.48

* cited by examiner

CRYOGENIC SUBMERGED PUMP FOR LNG, LIGHT HYDROCARBON AND OTHER ELECTRICALLY NON-CONDUCTING AND NON-CORROSIVE FLUIDS

CROSS-REFERENCE TO RELATED APPLICATIONS

This non-provisional application claims priority to provisional applications 61/910,070 filed on Nov. 28, 2013 and 62/058,795 filed on Oct. 2, 2014, the contents of which are both fully incorporated herein with this reference.

DESCRIPTION

Field of the Invention

The present invention generally relates to cryogenic submerged motor pumps. More particularly, the present invention relates to a novel permanent magnet submerged motor cryogenic single or multistage centrifugal pump that operates at a higher rotative speeds than comparable submerged induction motor cryogenic centrifugal pumps.

The most common application of submerged pumps is in the LNG supply industry where pumps are used to transfer the product from storage tanks to LNG carriers (special ships) at the production plant, from the carriers to shore-side storage tanks and then pumped at high pressure through vaporizers to pipelines. In addition, there is a distribution sector of the LNG Industry that requires smaller pumps for services such as fuel supply booster, fuel transfer, ship fuel bunkering, trailer loading, etc. Furthermore, the disclosure herein can be applied to other cryogenic fluids including but not limited to liquid nitrogen, liquid argon and liquid carbon dioxide.

There are a multiplicity of applications for a high speed cryogenic submerged motor pumps that may be used in light hydrocarbon and other electrically non-conductive and non-corrosive services, involving different conditions of fluid discharge rate (flow) and different pressure rate (head). It will be apparent to one skilled in the art that several sizes of pumps will be required to effectuate efficient operation at different rates of flow. It will be further apparent that by adding or subtracting pump stages the head of a pump can be changed in proportion to the total number of stages employed. It will be apparent that any pump constructed that embodies the arrangements and features described herein will deliver similar benefits to the user regardless of size.

Background of the Invention

Cryogenic submerged motor pumps for LNG and other electrically non-conducting fluids were invented in the early 1960's. Their invention is widely credited to California engineer and businessman J. C. Carter (U.S. Pat. No. 3,369,715 Submerged Pumping issued on Feb. 20, 1968). The cryogenic submerged motor pump is designed to address the special problems of the metal and other materials, as well as the propensity of the fluid to boil off with the ingress of heat from the energy input required to operate the pump. Prior to the invention of the submerged motor pump, conventional petrochemical process pumps that embodied mechanical shaft seals and explosion proof conventional induction motors were used and adapted to handle LNG and other cryogenic fluids. Conventional process pumps suffer the disadvantage of seal and bearing wear, the result of which is to permit product leakage to the surroundings creating a potentially explosive atmosphere when the nature of the pumped fluid allows it to become vapor at ambient temperatures.

The cryogenic submerged motor pump in common use today embodies the induction motor, normally driven at 50 or 60 Hz frequency, depending on local power systems, which has limited the operating speeds to 1475 or 2970 rpm at 50 Hz or 1750 rpm or 3560 rpm at 60 Hz. Where system requirements dictate variable speeds, the historic practice has been to limit speeds to the maximum of those shown above. The motor including its electrical stator and its rotor, together with its required bearings, directly coupled to the pump impeller(s) are all contained within the pump pressure casing. Three-phase electric power is applied through electrical conductors to the submerged induction motor through a static hermetic dual seal. That seal that acts as a barrier between the pumped process fluid and the surrounding atmosphere, preventing the fluid from the pump or air into the pump. Either condition could create a potentially explosive atmosphere.

The arrangement of the cryogenic submerged motor pump obviates the need for a shaft seal, thereby increasing the reliability and the potential safety of such units. Furthermore, the most commonly used materials of construction of the unit are well known, with due care taken to ensure their application takes account the dimensional changes and property changes that occur during the transition from ambient temperature conditions to the extreme low temperatures under cryogenic conditions.

It is very desirable to increase the durability and efficiency of a cryogenic submerged motor pump while reducing cost and overall size, the benefits of which may be reduced capital and operating expenses. Accordingly, there is always a need for an improved cryogenic pump as is disclosed herein below.

SUMMARY OF THE INVENTION

An embodiment of a cryogenic submerged multi-stage pump assembly includes a vertically oriented pump shaft. An electrical motor includes a rotor attached to the pump shaft and a stator disposed about the rotor. The electrical motor is a permanent magnet electrical motor. A first-stage impeller assembly includes a first impeller attached to the pump shaft, the first impeller configured to move a cryogenic fluid from a first impeller inlet to a first impeller outlet when the pump shaft is rotated by the electric motor. A first impeller housing is disposed about the first impeller and configured to channel the cryogenic fluid once it exits the first impeller outlet. A second-stage impeller assembly includes a second impeller attached to the pump shaft, the second impeller configured to move the cryogenic fluid from the first impeller housing to a second impeller inlet and then to a second impeller outlet when the pump shaft is rotated by the electric motor. A second impeller housing is disposed about the second impeller and configured to channel the cryogenic fluid once it exits the second impeller outlet to a discharge tube or discharge outlet. The first-stage impeller assembly is disposed below the second-stage impeller assembly. The second-stage impeller assembly is disposed below the permanent magnet electrical motor.

In other embodiments, the rotor may include four magnetic poles where the four magnetic poles may be made from samarium cobalt.

The electrical motor may be powered and controlled by a remote-mounted inverter or remote-mounted variable frequency drive configured to convert incoming three-phase 50 or 60 Hz power to a voltage level from 380 to 690 volts at an output frequency which is 10-100% of 240 Hz.

The electrical motor may be configured to operate above 4000 rpm, above 5000 rpm, above 6000 rpm or above 7000 rpm.

The rotor may have a height which is at least 3 times, 4 times or 5 times a diameter of the rotor.

In another embodiment a suction inducer may be attached to the pump shaft and disposed below the first-stage impeller assembly. As best seen in FIG. 1B, the suction inducer comprises an inducer hub with a plurality of helically extending blades, wherein the inducer hub comprises an outside surface having a first diameter 63 at a bottom section of the inducer hub, a second diameter 64 in a middle section of the inducer hub, and a third diameter 65 at a top section of the inducer hub 65, where the second diameter is larger than the first and third diameters. The plurality of helically extending blades may extend to a common outermost diameter 66. The inner surface of the first impeller at the first impeller inlet may have a diameter approximately similar to the third diameter of the inducer hub 65. In an embodiment there is not a static diffuser along the cryogenic fluid flow path after the suction inducer and ahead of the first impeller. In another embodiment the plurality of helically extending blades may be disposed at or below the middle section of the inducer hub wherein there are no plurality of helically extending blades near the top section of the inducer hub.

The pump shaft may be a keyless pump shaft. Prior art pump shafts have keyways or slots formed into the surface of the shaft such that keys or inserts may be placed within that then lock to an outer structure. The Applicant's invention is keyless meaning that no slots or cuts are made into the shaft surface. This allows the shaft to be smaller in diameter and still retain required structural properties. A smaller diameter shaft reduces the moment of inertia and allows the spinning mass to be more responsive to the balance thrust mechanisms.

The first impeller and second impeller may be both attached to the pump shaft by a tapered collet, the tapered collet attached to the pump shaft by an interference fit. The tapered collet may have a frustoconical outer surface which is larger in diameter closer to the bottom of the tapered collet when installed on the pump shaft. Then the first and second impellers may have a frustoconical inner surface configured to match the frustoconical outer surface of the tapered collet.

A motor casing may be disposed about the stator. The motor casing may include an upper bearing housing at the top of the motor casing and a lower bearing housing at the bottom of the housing. Each bearing housing is configured to retain a ball bearing assembly and each bearing housing comprises in inner shoulder surface, wherein a first gap between the inner shoulder surface and the rotor is less than a second gap between the rotor and the stator.

A plurality of tie rods may be configured to fixture the first-stage and second-stage impeller assemblies in a fixed relationship. Alternatively, a pump housing may be disposed about the first-stage and second-stage impeller assemblies, the pump housing configured to fixture the first-stage and second-stage impeller assemblies in a fixed relationship.

In another embodiment the electric motor may include an upper ball bearing assembly disposed near or at a top portion of the electric motor, and including a coolant supply tube in fluidic communication with the first-stage impeller assembly and the upper ball bearing assembly.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
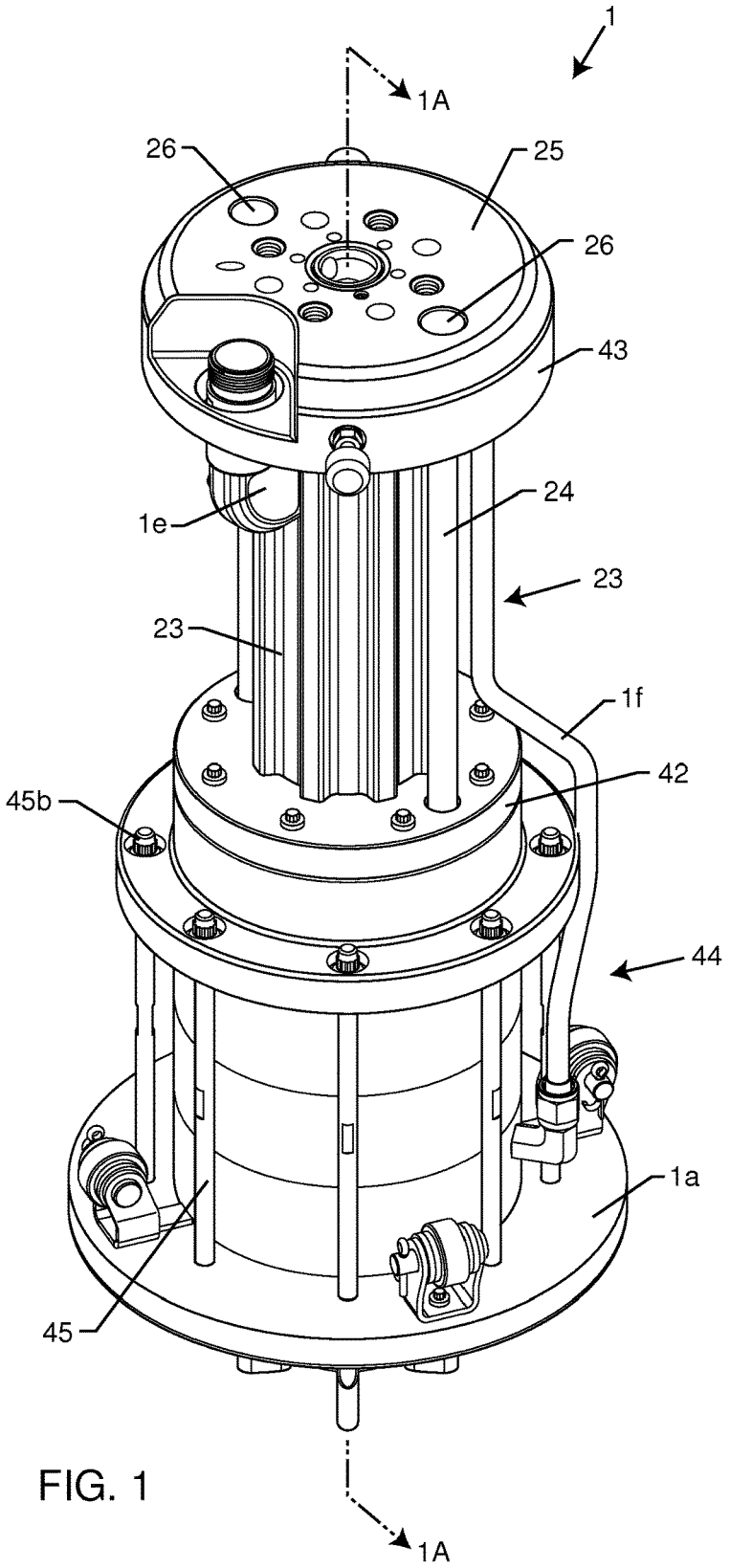
FIG. 1 is a perspective view of an exemplary cryogenic pump embodying the present invention.

Induction motors have been used in the prior art for cryogenic pumping systems. However, induction motors have rotor resistance losses that cannot be avoided due to their very nature. An AC (Alternating Current) induction motor consists of two assemblies—a stator and a rotor. The interaction of currents flowing in the rotor bars and the stators' rotating magnetic field generates a torque. In actual operation, the rotor speed always lags the magnetic field's speed, allowing the rotor bars to cut magnetic lines of force and produce useful torque. The difference between the synchronous speed of the magnetic field, and the shaft rotating speed is slip—and would be some number of RPM or frequency. Slip increases with an increasing load, thus providing a greater torque, however suffering rotor resistance losses.

A permanent magnet motor is more efficient as compared to a comparable inductor motor because the magnetic field is always present and does not change with load. Also, a permanent magnet motor is smaller and lighter, allowing it to be packaged more efficiently. For instance, a 2.5 kW induction motor is about the size of a one-quart paint can whereas a comparable 2.5 kW permanent magnet motor is about the size of a baby bottle. However, in the prior art it was not known to those skilled in the art whether a permanent magnet motor would work at such low temperatures that are used in cryogenics and cryogenic pumping. Conductivity and material properties change when the temperatures are as low as cryogenic temperatures, and there was no confidence that such changes would not be deleterious to performance or reliability.

Another problem is that cryogenic pumping usually requires running the pump at slower speeds to minimize viscous friction drag. Further, the pervasive thought in the art is to run the motor as slow as practical to increase durability, reliability and longevity. Induction motors are better for running at slow speeds and permanent magnet motors are better suited for higher speeds. Therefore, due to the reasons above, it was never contemplated by those skilled in the art to attempt to use permanent magnet motors for pumping cryogenic fluids.

For instance an induction motor for a cryogenic pump, whether submerged motor or conventional motor with shaft seals, will commonly operate at 2960 rpm on a 50 cycles/second system or at 3540 rpm on a 60 cycles/second system. Frequently, there is a gear drive on all induction motor cryogenic pumps that turns the impeller faster or slower as required to better satisfy the flow and pressure requirements. The gear reduction may be on the order of 0.5 to 2.2. The Applicant has gone against the conventional thought and designed a system utilizing a permanent magnet motor that runs between 4,000-10,000 rpm on a 133-333 cycles/second system. The Applicant has also eliminated the gear drive required for inductor motor systems and now runs the impellers directly connected to the permanent magnet motor shaft. Also, the Applicant has moved away from a single impeller and utilizes a number of smaller impellers to pump the cryogenic fluid. Before the Applicant's invention it was not contemplated by others skilled in the art to use a direct drive permanent magnet motor running at above 3000 rpm (or even above 3600 rpm) because of longstanding common practice based on limitations of common motor starting equipment and the desire to run at the slowest possible speeds to reduce wear and tear.

In an embodiment of the invention, the submerged induction motor of the prior art is replaced by a submerged permanent magnet motor of reduced size operating at a high speed and efficiency. This embodiment embodies four (4) magnetic pole pieces that use improvements in rare earth magnets, especially Samarium Cobalt. The magnet poles are secured to a magnetic stainless steel shaft by magnet force and by a circumferential non-magnetic sleeve that prevents centrifugal forces of rotation from detaching the poles during motor operation. The advantage of a 4-pole arrangement motor permits the use of a remote-mounted inverter or variable frequency drive that converts incoming three-phase 50 or 60 Hz power at any voltage level from 380 volts to 690 volts at output frequency of 10% to 100% of 240 Hz at a common voltage range from 10% to 100% of the input voltage. A further advantage of the 4-pole arrangement is the smooth cog-free operation over the entire frequency range. The prior art of submerged cryogenic induction motors, rotor length is constrained by technical manufacturing considerations that limit the length of the rotor in relation to its diameter.

It is well known that the parasitic losses associated with all electrical motors include "windage" losses caused by fluid friction where a body, such as the motor rotor, rotates in a viscous fluid, and with the energy required to circulate some of the fluid through cooling channels around and through the motor to remove the heat produced as a result of those losses. As known to those skilled in the art, those viscous friction losses for a given fluid at a particular temperature are functions of fluid viscosity, rotative speed $N^{2\ (squared)}$, rotor diameter $D^{4\ (fourth\ power)}$ and rotor length $L^{1\ (directly)}$. In a common air-cooled induction motor pump these parasitic losses represent less than 1% of the total motor power due to the negligible viscosity of air. In the prior art submerged induction motor pump these parasitic losses consume more than 5% of total motor power because light hydrocarbons such as LNG, etc. have high viscosity compared with air. It will be apparent that a significant improvement of unit efficiency would result from the reduction of such parasitic losses.

An embodiment disclosed herein employs rotor geometry that obviates the limitations imposed by the geometry of the prior art submerged motors. The embodiment incorporates rotors, the length of which, is determined by critical speed considerations allowing rotor diameter to be reduced by as much as 60%. The speed and power of the submerged motor of the embodiments disclosed herein are generally doubled as when compared with an induction motor of similar mass. For a given shaft power rating, the electrical power consumption is generally reduced by 3 to 5%. This means the rotor used herein may have a length (height) along the pump shaft that is over 3, 4 or 5 times the diameter, or said otherwise having an aspect ratio (length:diameter) of over 3, 4 or 5. This is best seen in FIG. 2D where the rotor diameter 61 can easily be seen to be substantially less than the rotor height 62.

The submerged motor pump of the prior art consists of a plurality of parts and components, the configuration of which is dictated by functional requirements. The form of the majority of such parts and components are frequently complicated by the hydraulic design. The parts and components are usually formed by machining from metal sand or investment castings. For the present application, aluminum or bronze are commonly used. It is well known that cast parts are subject to defects such as porosity, shrink, cracks, voids, and poor surface finish that can only be detected by costly examination or at the machining stage. Further, surface quality can only be remediated by hand finishing. Accordingly, the functionality of such parts can be highly variable due to the vagaries of the casting process, resulting in significant variations in performance from unit to unit, even though the desired performance is intended to be repeatable. In the embodiments disclosed herein parts and components are configured to permit forming by machining from wrought aluminum or bronze plates, bars or forgings thereby yielding accurate, repeatable, parts and components having fair, smooth surfaces. Pumps assembled from such parts will produce uniform and superior performance from unit to unit and even batch to batch. The embodiments herein may incorporate a pump impeller or impellers that are fabricated from a hub that embodies a plurality of vanes (blades) to impart energy to the pumped fluid, and a front shroud the contour of which is formed to match a corresponding form on the edge of the impeller blades. The shroud is affixed to the vane edges of the shroud by thermal fusion, one part to the other.

FIG. 1 is a perspective view of an exemplary cryogenic pump 1 with a four stage impeller system showing the seal seat ring adapter 1*a* for mounting in a double chamber vessel or pump well. The description of the embodiments is sequenced in order of the fluid flow from pump inlet to pump outlet. The description herein pertains to a four stage version, however it will be apparent that a similar pump disclosed herein having more or less stages is a practical possibility and is one of the variables used to associate a particular pump with a particular pressure requirement. Therefore, any number of stages can be used from one stage to two stages, three stages, five stages or any number of stages. It will be similarly apparent that the size of the pump may be altered by scaling the fluid passages or by other adjustments to fluid passage areas known according to the experience of those skilled in the art for the purpose of increasing or decreasing the discharge flow of a similar pump to the embodiments disclosed herein.

Figure 1A:
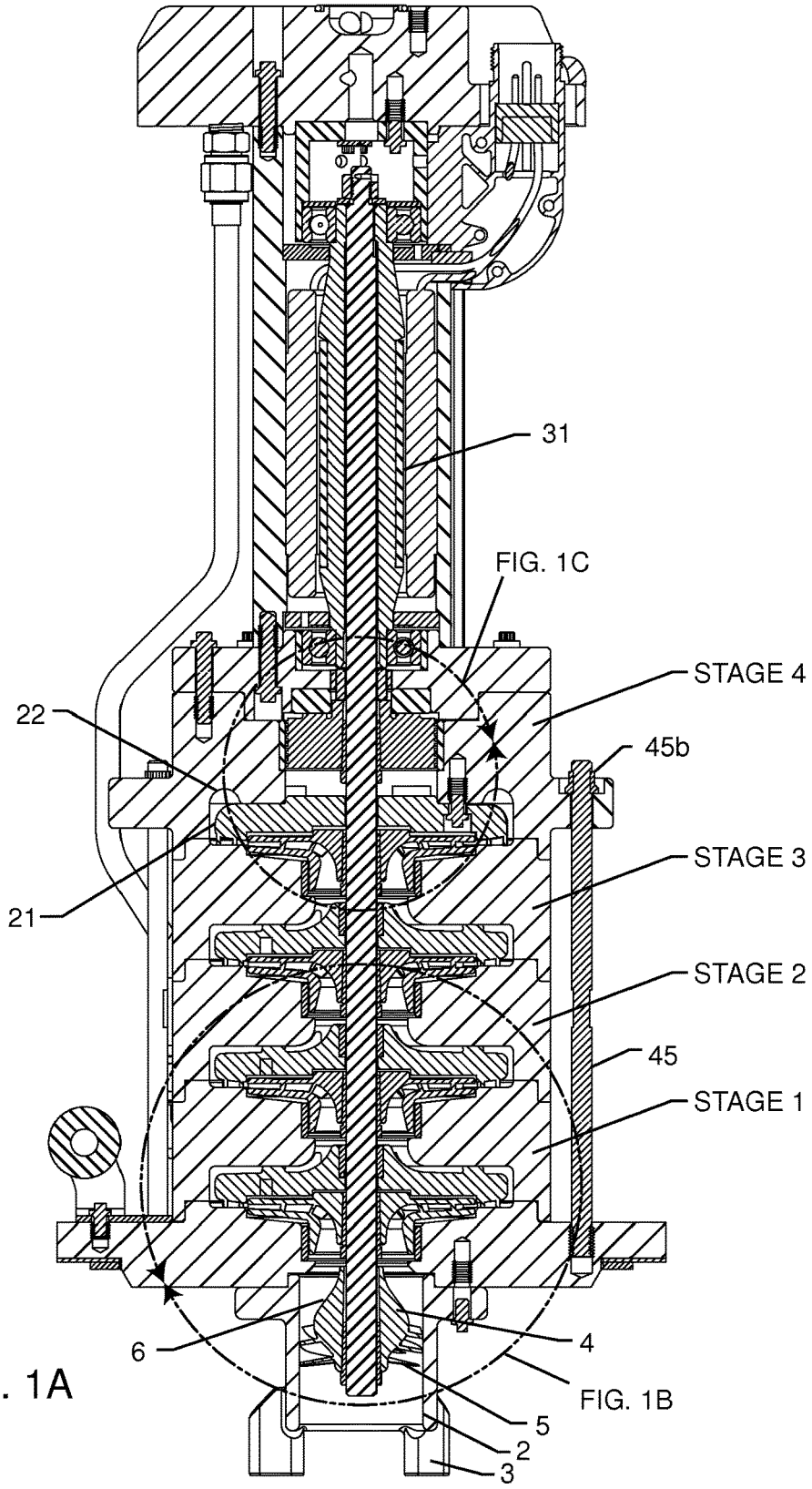
FIG. 1A is a sectional view of the pump depicted in FIG. 1.

FIG. 1A is a sectional view of the pump 1 depicted in FIG. 1. The cryogenic fluid flows radially toward the pump suction inlet 2, past four radially disposed vanes (blades)

located to optimally guide the flow. The fluid is drawn upward into the pump suction inlet 2 toward an area of reduced pressure, caused by suction inducer 4. The extension 3 keeps the bottommost portion of the pump suction inlet 2 from touching the bottom of a well or surface such that the inlet 2 would be plugged or prevent suction of cryogenic fluid into the inlet 2.

The suction inducer 4 is of the extreme performance type and machined from forged aluminum. In this embodiment, the four vanes 5 and the inducer hub 6 are shaped by removing material between each blade with a 5-axis programmed milling machine. The shape of the vanes 5 is defined by a skilled hydraulic designer and qualified by analysis using a CFD computer tool then by prototype testing. The four vanes 5 in the inducer 4 of this embodiment has been found to provide equal performance to prior art three main vanes and three splitter vanes (diffuser) described in U.S. Pat. No. 7,455,497 and simplifies the manufacturing process. The inducer hub 6 extends in the direction of flow (upwards) beyond the trailing edge of the vanes 5 and is tapered to provide a diffuser zone where actual diffuser (stationary vanes) are no longer needed. In the embodiments disclosed herein, no stationary vanes (diffuser) are used. A diffuser or stationary vanes are used in the prior art to straighten the flow of the cryogenic fluid before it enters the pump. Here, the curvature of the inducer hub 6 and the related curvature of the pump unit itself eliminates the need for stationary vanes (diffuser). Energy is no longer lost or wasted on the stationary vanes (diffuser) and this results in an increase in efficiency.

Figure 1B:
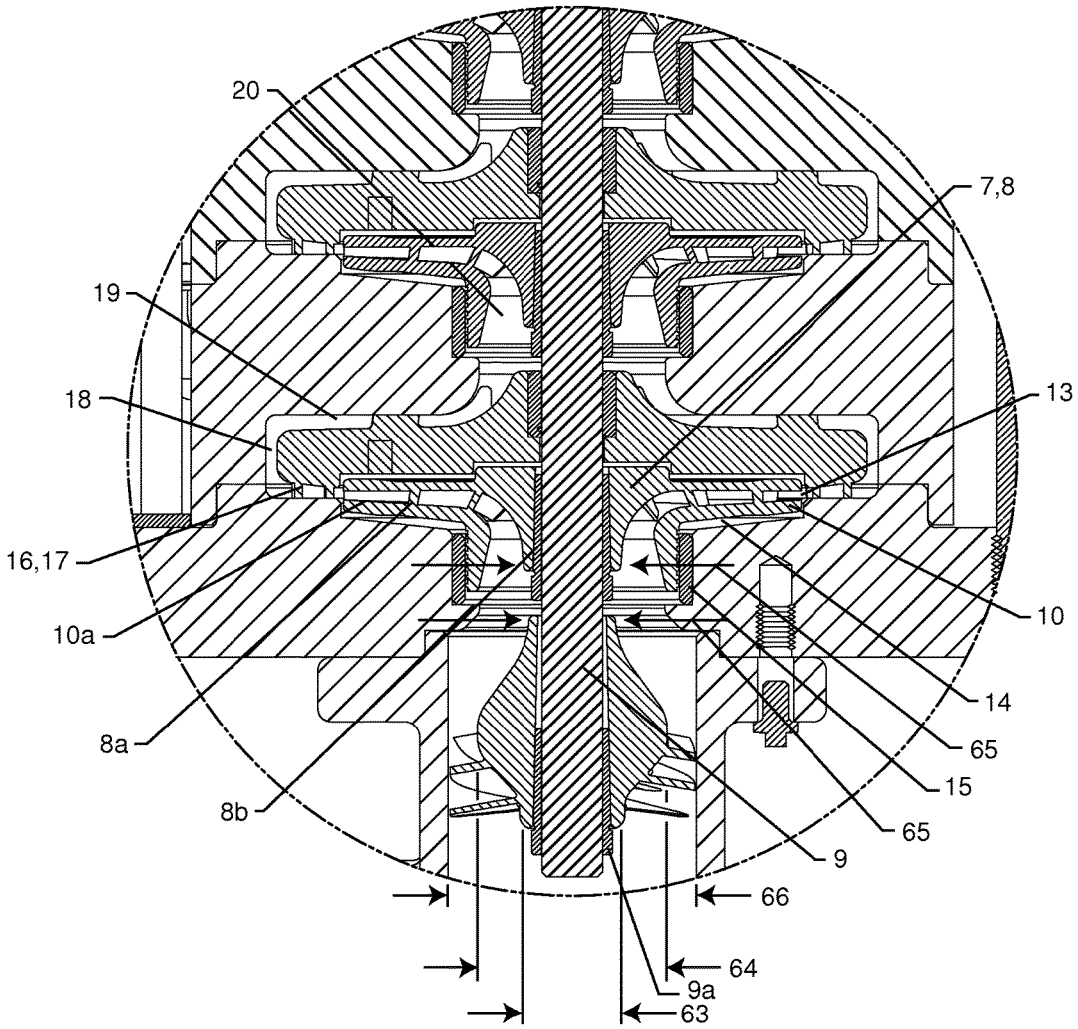
FIG. 1B is an enlarged sectional view taken from FIG. 1*a* and depicts the arrangement of the first stage of the pump depicted in FIG. 1.

FIG. 1B is an enlarged sectional view taken from FIG. 1A and depicts the arrangement of the first stage of the pump. The pumped fluid exits the pump suction inlet 2 and suction inducer 4 where its energy level has been raised providing positive suction head to the first-stage impeller 7, of the single suction type, at its inlet. The impeller is a unique design that is fabricated comprising an impeller hub 8 and a shroud 10 of aluminum joined together by a brazing process along vane edges 10*a*. The impeller vanes 8*a* and the hub shape are formed by machining integral to the hub. Typical prior art impellers are cast in one piece. Impellers are complicated structures and the casting process can become financially expensive and labor intensive. The Applicant utilizes a new impeller that is machined in two parts and then brazed together. This reduces the manufacturing cost, speeds up production and results in a product that can withstand higher rotative speeds and better performance. The two parts, hub 8 and shroud 10 are machined from wrought aluminum blanks, and joined together by a brazing/fusion process.

The suction inducer 4 and each impeller is driven by a pump shaft 9 and each is retained in its correct location by a tapered collet 9*a* which is emplaced by driving the collet 9*a* into a tapered bore 8*b* in the impeller hub. In operation for a typical single suction pump impeller, a minor amount of fluid (leakage) recirculates from the impeller discharge 13 through an annular space 14 then through a running clearance between the impeller and a (bronze) wearing ring 15. The running clearance is minimized to limit leakage efficiency loss. To prevent the aluminum impeller 7 from becoming prematurely degraded from rubbing against the wearing ring 15, the impeller surface may be coated with a hard anodized type 3 class 1 coating.

The major part of pumped fluid is discharged into the entry to the flow channels of a radial-style diffuser 16. The diffuser 16 converts flow energy to static pressure according to laws of physics well known to those skilled in the art. At the outer extremity of the channels defined by diffuser vanes 17, the fluid enters a return zone 18, where the radial component of velocity is reversed and flow is directed into another set of channels 19 causing the fluid to return to the second stage impeller inlet 20 and cause the flow direction and velocity to match that of impeller inlet vane angle.

The pumped cryogenic fluid progresses through intermediate stages two and three in a manner identical to the first stage, with each successive stage imparting additional energy to the pumped fluid in the form of increased pressure. In the case of the depicted pump herein, the fourth stage is the final stage. Fluid passes through the stage in a manner alike to the previous stages until it reaches return zone 21. There the fluid enters a discharge collector 22.

As shown in FIG. 1, the major part of the collected discharge fluid is directed past the permanent magnet submerged motor assembly 23 through discharge tubes 24 through a discharge manifold 25 through two or more discharge nozzles 26 and into a space in a pump well or a suction vessel of the two chamber type. It will be apparent that the number, and size of the discharge tubes 24, discharge manifold 25 and discharge nozzles 26 and associated components will be a function of the desired pump discharge flow.

The prior art of submerged motor pumps embodied a thrust balance mechanism, also referred to as a balance drum that is intended to neutralize thrust imposed by unbalance hydraulic forces produced by the impellers, in a manner apparent to those skilled in the art. The arrangement allows the pumping element and the motor rotor to float along the unit rotational axis such that pressure variations on a balance drum or piston causes the entire rotating element to open and close a throttle seal to open and close as necessary for thrust balancing to occur. An embodiment herein incorporates a novel mechanism that achieves the same result, such that the axial movement of the thrust mechanism is independent from any excursions that the rotor mass may incur. Because the rotating mass of thrust balance mechanism is low (compared to systems of the prior art) it renders the system more responsive to the transient hydraulic pressure excursions that occur when pumping conditions change.

Figure 1C:
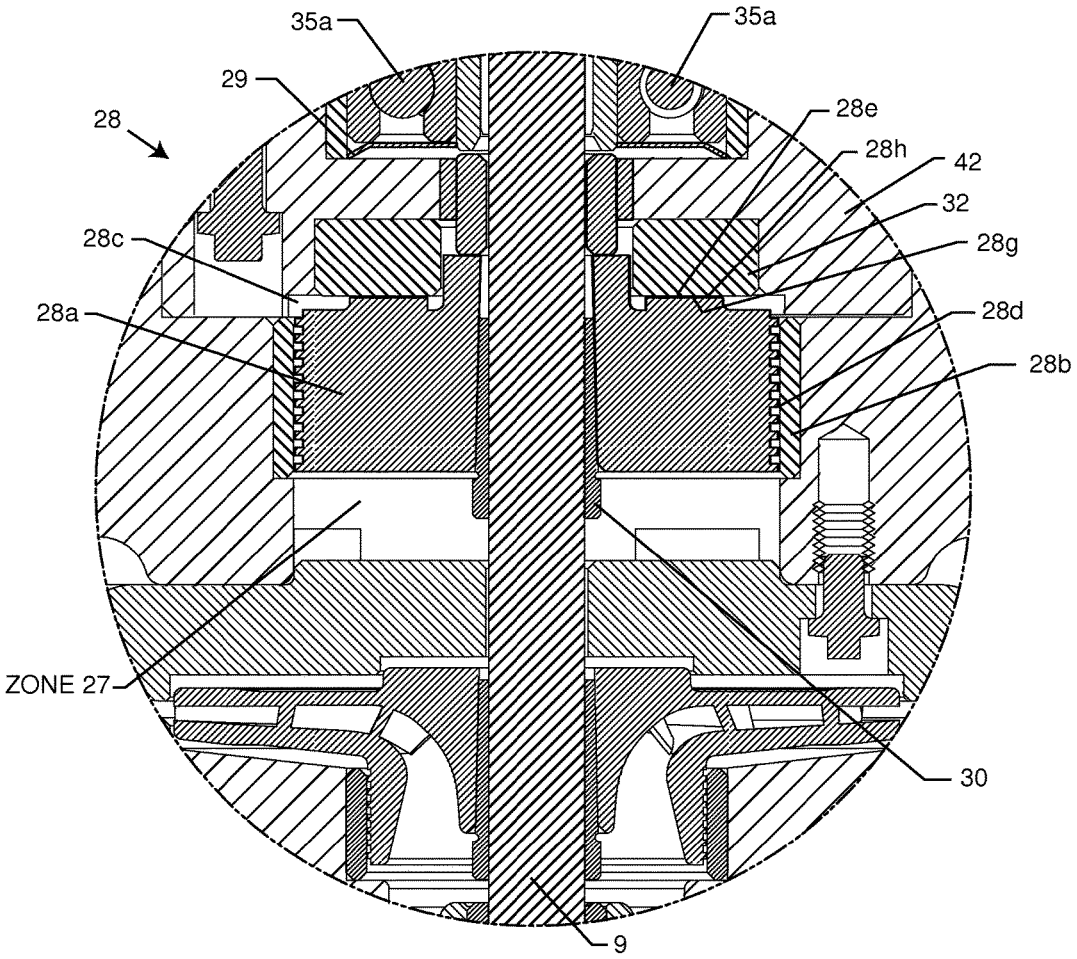
FIG. 1C is an enlarged sectional view taken from FIG. 1*a* and depicts the arrangement of the thrust balance mechanism.

More specifically, it is known that a vertical single-suction, single-stage or multistage pump, without hub side wearing rings and thrust balance ports will exert a positive force, or down thrust, on the pump shaft. The Applicant's novel design is shown in FIG. 1C which is an enlarged sectional view taken from FIG. 1A and depicts the arrangement of the thrust balance mechanism 28. A balance drum 28*a* is attached to the pump shaft 9 by means of a tapered collet 30. A minor portion of the discharge fluid is directed into the zone 27 below the balance drum 28*a*. The pressure of the fluid at zone 27 will be at pump discharge pressure. The fluid pressure exerts a negative force (referred to the force of gravity), or up thrust, on the pump shaft 9. Because the pressure in the motor cavity zone 31 is less than that in the zone 27, cryogenic fluid will preferentially migrate through an annular space (labyrinth of grooves) 28*d* between balance drum 28*a* and a stationary sleeve 28*b* toward zone 28*c* above the balance drum 28*a*. It will be apparent that the pressure at zone 28*c* will be less than that at zone 27 because of pressure losses across labyrinth grooves 28*d* on the outer periphery of balance drum 28*a*. The resulting downforce of the pressure in zone 28*c* being less than the up thrust from zone 27 will result in a net up thrust on the balance drum.

The fluid in zone 28*c* will continue to flow toward the motor cavity 31 through the throttle gap 28*e* that is formed between the seal surface 28*g* of the balance drum 28*a* and the face 28*h* of baffle plate 32. The flow through the throttle gap 28*e* causes the pressure in zone 28*c* to diminish, resulting in an increased up thrust on the balance drum 28*a*. When the resulting up thrust exceeds the hydraulic down thrust, the balance drum 28*a* lifts the pump shaft 9 causing the throttle gap 28*e* to be reduced (or close). In turn, the flow diminishes and the pressure in zone 28*c* increases thereby reopening the throttle gap 28*e*. Each excursion of the shaft causes the pressure in zone 28*c* to fluctuate which on average results in a balanced thrust condition. The net thrust force on the pump shaft 9 is the hydraulic down thrust minus the balance up thrust. It is this unbalanced force that the motor bearings 35 must resist. By calculations, the size of balance drum 28*a*, annular space 28*d* and seal surface 28*g* needed to maintain a balanced thrust condition on the motor bearings 35 can be determined thereby prolonging the life of such bearings.

In this embodiment, the mass and inertia of the balance drum 28*a*, the pump shaft 9, and the components of the entire pump rotating assembly less than the comparatively massive motor rotating component as typical in the prior art. Therefore, the rotating mass of these embodiments is significantly reduced thereby improving the sensitivity of the thrust balance mechanism 28 altogether.

After having passed through the throttle gap 28*e*, that cryogenic fluid needed to maintain the operation of the thrust balance mechanism 28 flows into the permanent magnet submerged motor assembly 23 through its lower ball bearing 35*a* providing needed lubrication and removing heat from that component.

An embodiment disclosed herein provides a coolant supply tube if that ensures a flow of cryogenic fluid from the first stage to lubricate and cool the upper motor bearing 35*b* upon unit start up. Then, upon establishing steady state operation the coolant flow pattern changes such that last stage fluid flows past the thrust balance mechanism, then through and lubricating the lower motor bearing 35*a*, then through the motor rotor-stator gap 31 thereby removing heat produced by motor electrical losses, then through the upper ball bearing 35*b* for cooling and lubrication, then through the coolant supply tube 1*f*, where the warmed fluid is returned to first stage and mixes with the pumped fluid. In situations where the submerged motor pump is installed in a storage tank, the heat removed by the coolant portion of flow will be sent out with the discharge flow advantageously avoiding the production of boil off gas within the tank.

Figure 2A:
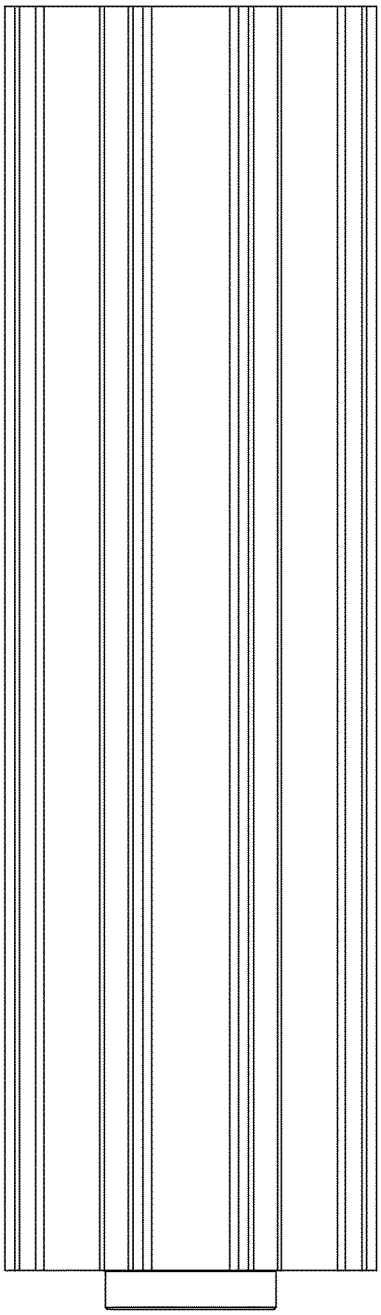
FIG. 2A depicts the embodiment of the exemplary submerged motor assembly 23 from FIG. 1.
Figure 2B:
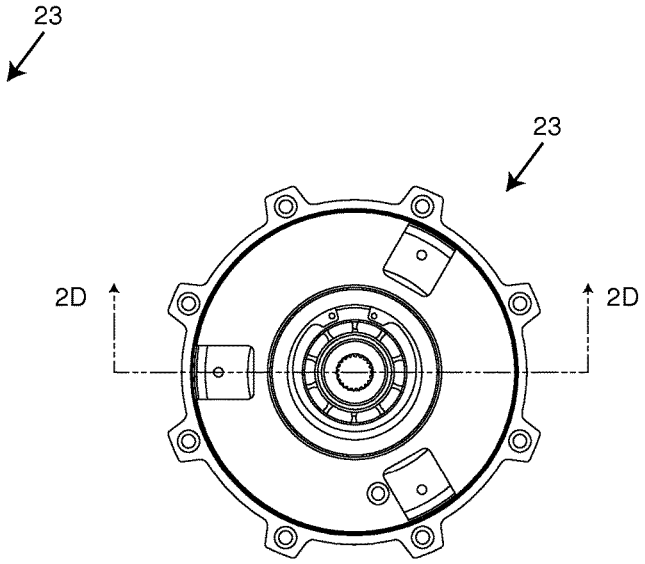
FIG. 2B is a top view of the structure of FIG. 2*a;*
Figure 2C:
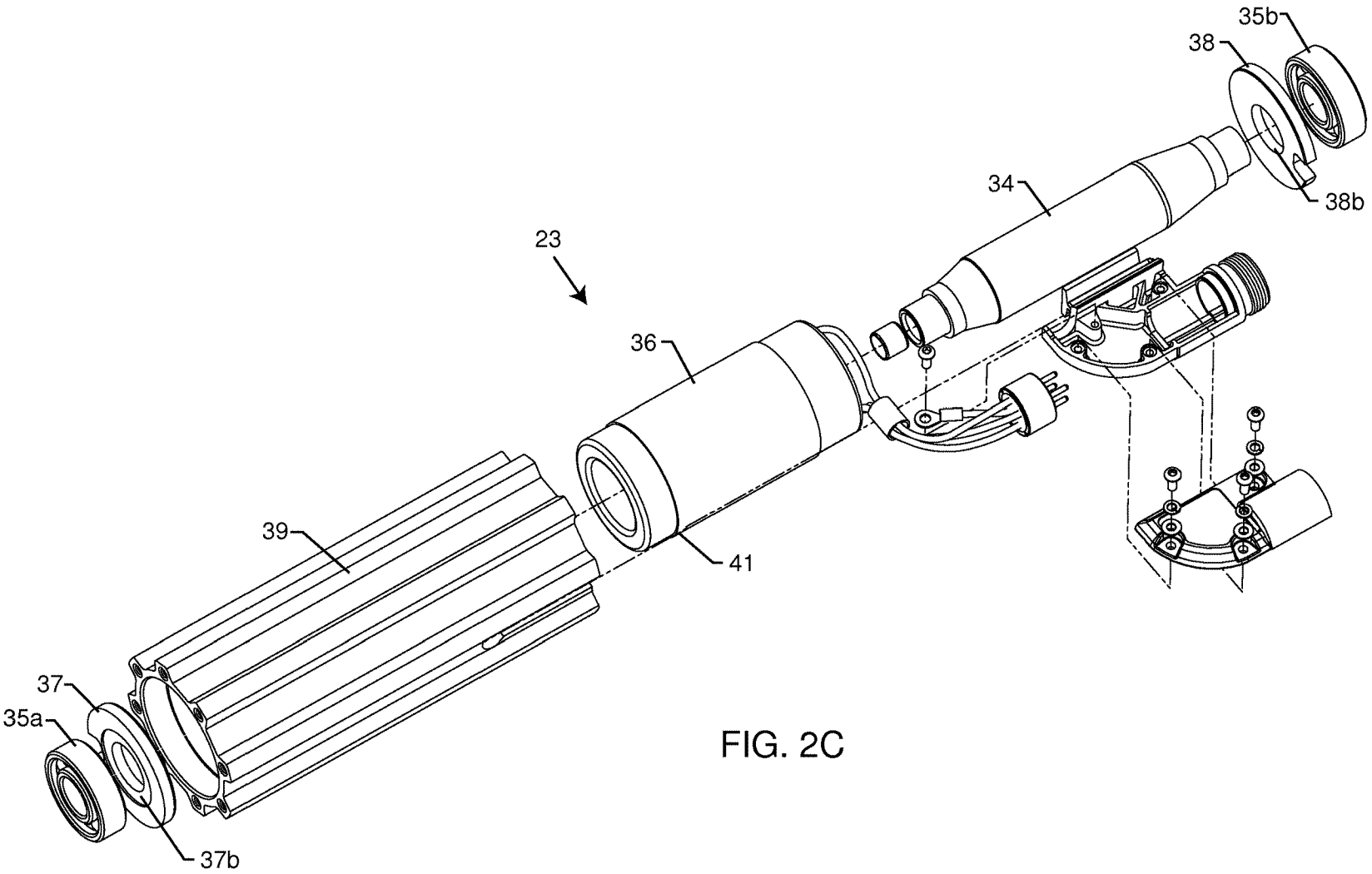
FIG. 2C is an exploded perspective view of the structure of FIG. 2*a;*
Figure 2D:
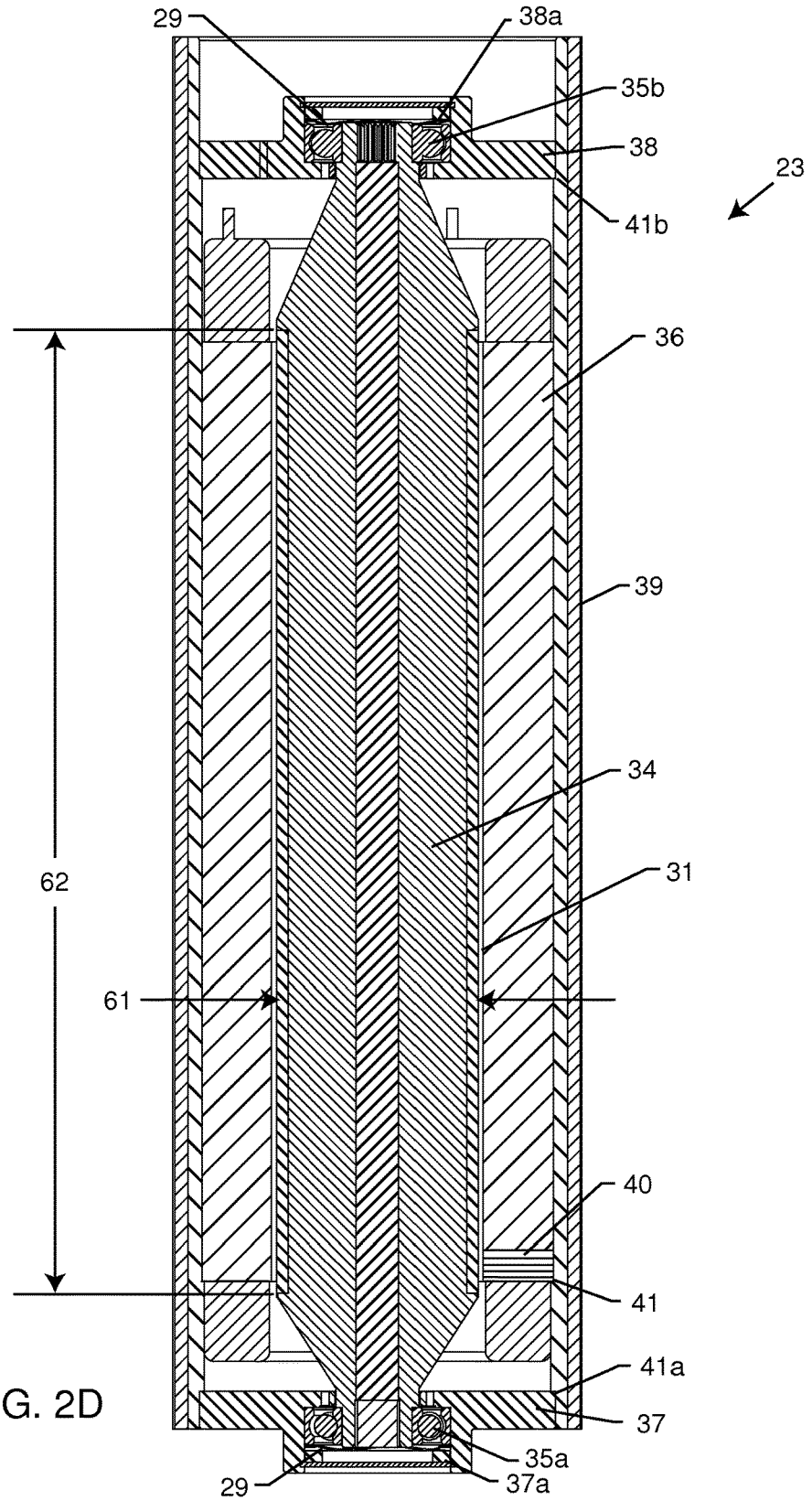
FIG. 2D is a sectional view taken along lines 2*d*-2*d* from FIG. 2*b;*

FIG. 2*a* depicts the embodiment of the exemplary submerged motor assembly 23 from FIG. 1. FIG. 2B is a top view of the structure of FIG. 2A. FIG. 2C is an exploded perspective view of the structure of FIG. 2A. FIG. 2D is a sectional view taken along lines 2D-2D from FIG. 2B.

The rotating components of the motor, i.e. the permanent magnet rotor 34, has its magnetic center aligned radially and axially with the magnetic center of the stator 36 suspended by a nonelectrically conductive ceramic lower ball bearing 35*a* in the lower bearing housing 37 and axially retained from upward motion and radial misalignment by the upper ball bearing 35*b* in the upper bearing housing 38. In this embodiment, the motor stator 36 is axially located within a motor casing 39 by the engagement of the lower end of the lamination stack 40 with a shoulder feature 41 in the motor casing 39. The stator 36 is restrained from axial, radial and rotational movement within the motor casing 39 by means of an accurately machined interference fit between the stator outside diameter and the inside diameter of the motor casing 39. The interference becomes more profound when the unit is in cryogenic conditions.

The position of the upper 35*b* and lower bearings 35*a* is determined by the position of each respective bearing housing, each against a respective shoulder feature 41*b* and 41*a* in the motor casing being held in position by an interference fit. In this embodiment the rotor 34 is permitted a certain amount of axial movement in the event of severe vertical vibrations, by the action of a wave spring 29 beneath the lower bearing 35*a* and above the upper bearing 35*b* with the benefit of limiting the acceleration forces on the bearings, to the value of 3× the force of gravity, or 3 g.

In this embodiment to facilitate easy replacement of bearings the shoulder 37*b* and 38*b* within each bearing housing is bored with a clearance to the rotor that is less than the rotor magnetic gap. Thus, when the bearings are removed for replacement, the magnetic rotor 34 is prevented from adhering to the stator bore 36, which condition prevents installation of new bearings without a special fixture.

The arrangement of submerged motors used in the prior art is such that the pump must be dissembled to access the bearings for replacement, however in some variants, the extent of such disassembly is less extensive. An embodiment disclosed herein includes a unitary permanent magnet submerged motor that may be removed as a unit permitting a spare motor to be installed and the unit quickly restored to service.

As best seen in FIG. 1, the motor 34 is provided with a lower motor plate 42 and an upper motor plate 43 that are secured to the motor casing 39 creating a unit that may be removed from the pump assembly 44 without inconvenient disassembly of the pump assembly 44.

As best seen in FIGS. 1 and 1A, the parts of the pump assembly 44 are held together to resist pressure developed within the pump to a level of 40 bar, by means of eight tie rods 45 and nuts 45*b*. It will be apparent to those skilled in the art that assembly of the motor using other appropriate motor plates will allow the depicted motor to be conveniently applied to different models of pump assemblies 44, each such application being merely a variation of the disclosed embodiments.

Figure 3:
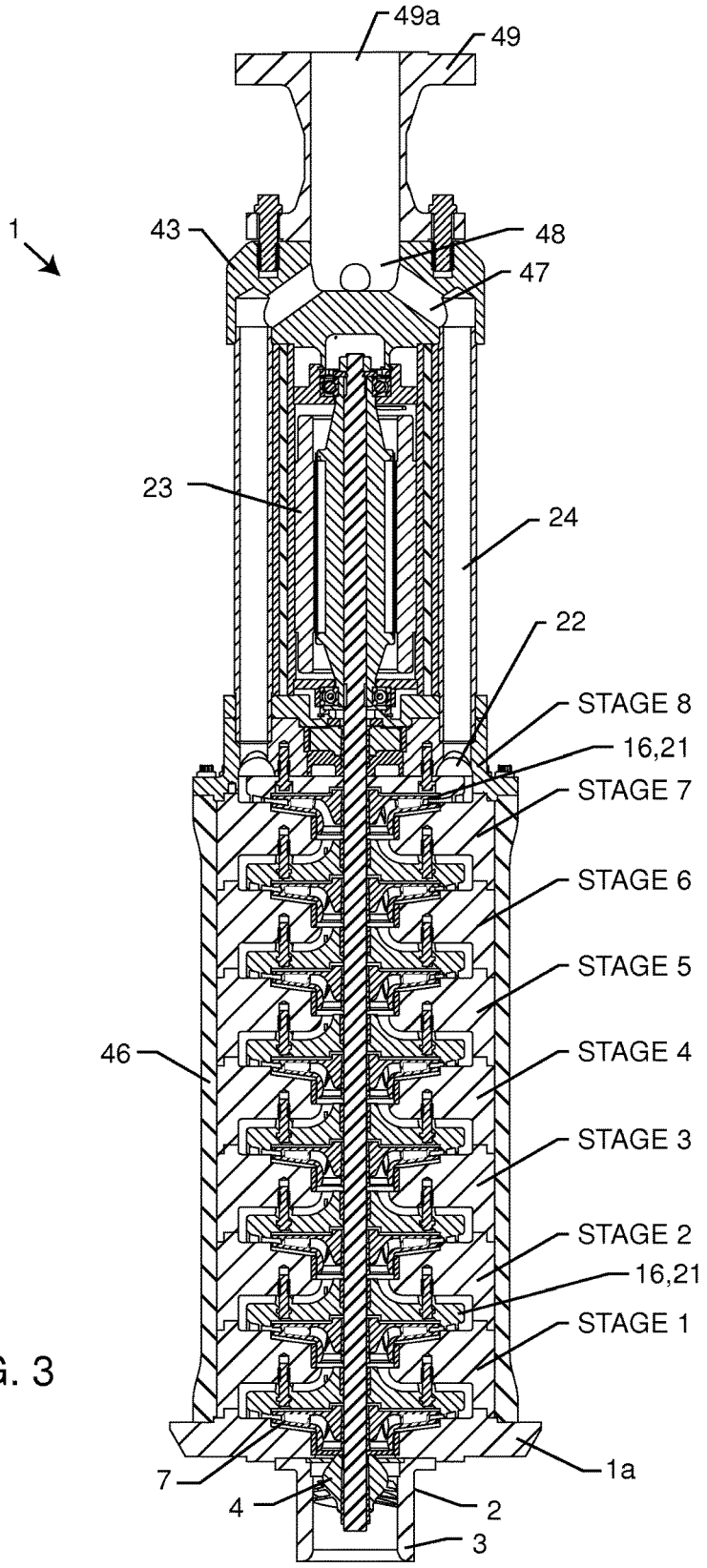
FIG. 3 is a sectional view of another exemplary cryogenic pump embodying the present invention.

FIG. 3 is a sectional view of another exemplary cryogenic pump assembly 1 embodying the present invention in which the unit is increased with additional stages to increase the pump discharge flow. As the number of stages is increased to increase the pump discharge pressure, a larger motor is applied to take account of the increased power required by the increased flow and discharge pressure. In addition, a pump housing 46 is fitted to replace the pump tie rods to provide the necessary strength required by pressure up to 60 bar.

The depicted version of FIG. 3 is modified to permit the pump to be installed in a single chamber sump. The pump discharge flow from the discharge tubes are collected in a revised upper motor plate 43 that provides four galleys 47 or channels that conduct fluid from to top of the discharge tubes to a central chamber 48. A discharge spool 49 conducts the combined flow from the chamber 48 to a discharge port 49*a* centrally positioned in a mounting flange that is commonly bolted to a piping system or to a discharge vessel head plate.

Figure 4:
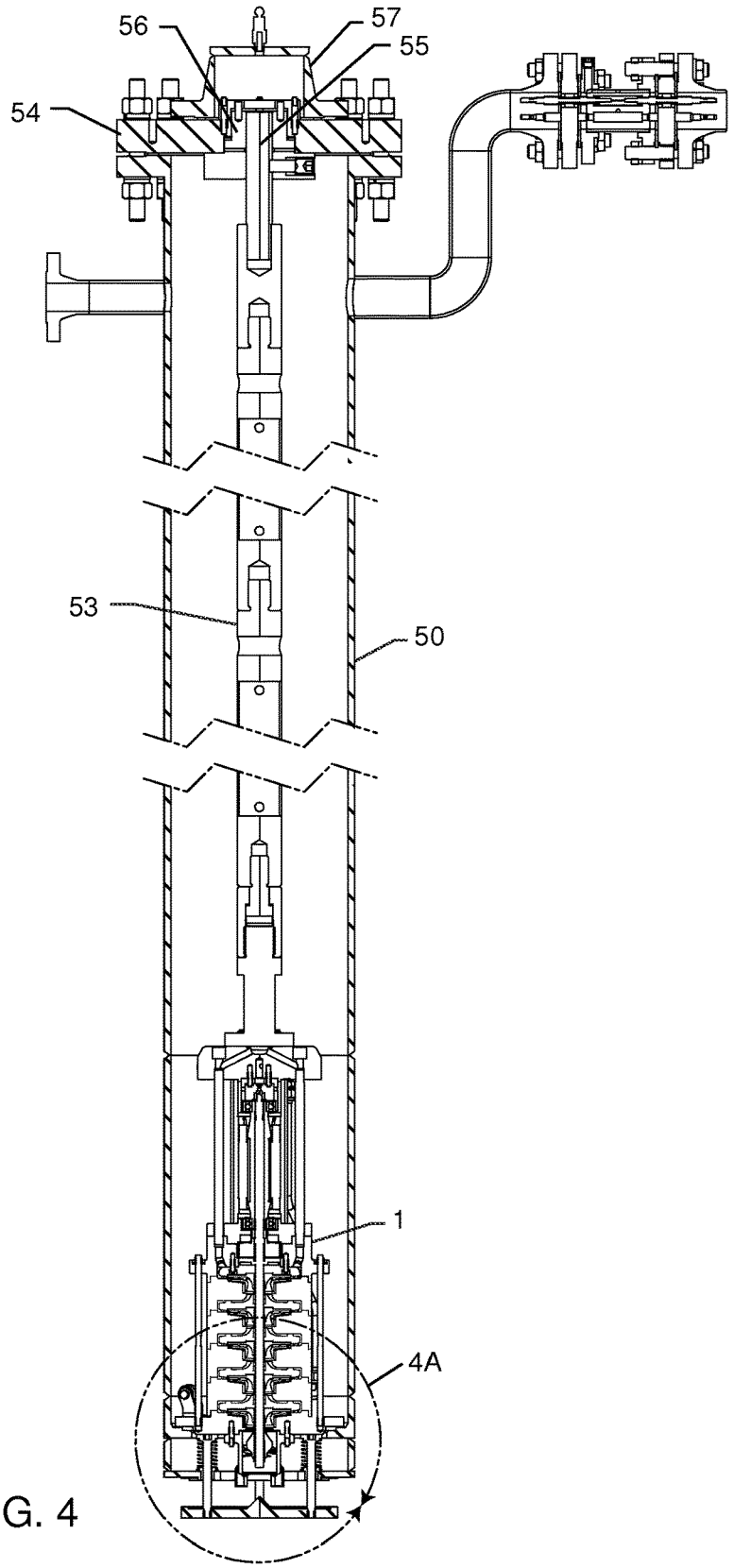
FIG. 4 is a sectional view of another exemplary cryogenic pump of the in-tank style embodying the present invention.
Figure 4A:
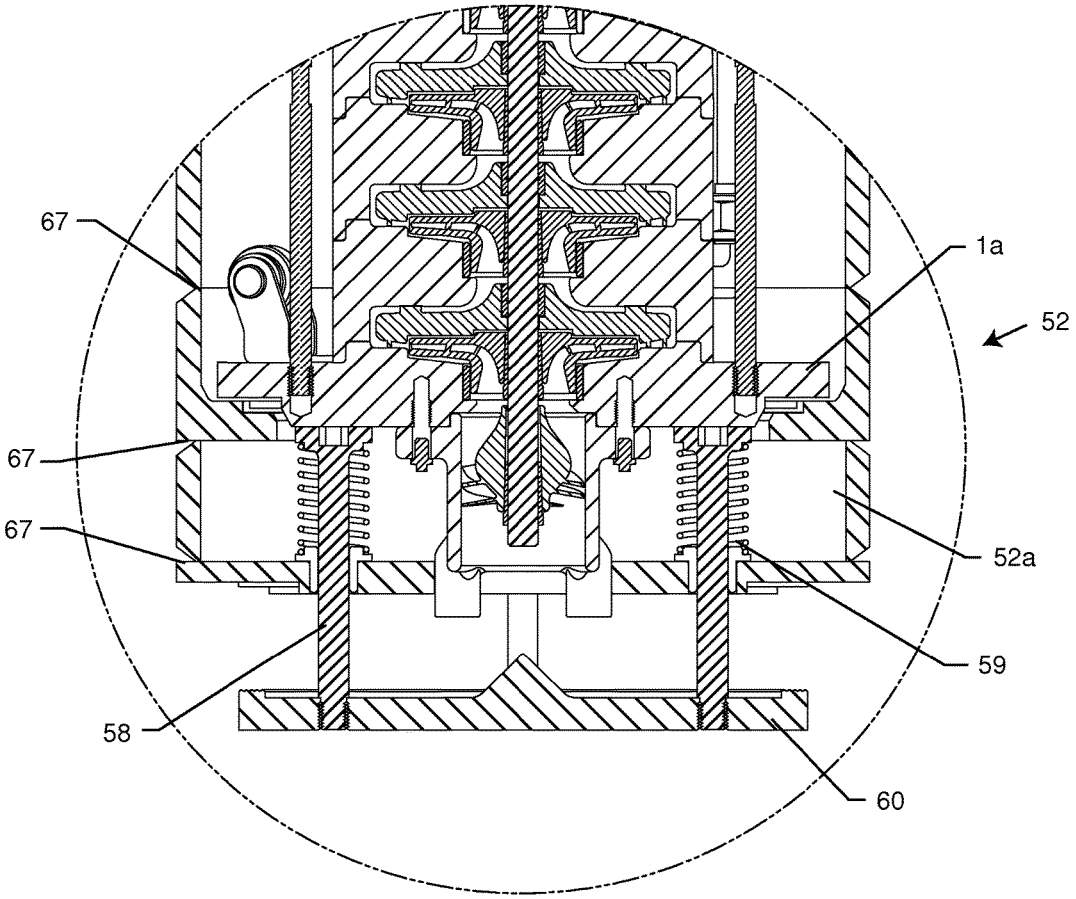
FIG. 4A is an enlarged sectional view taken from FIG. 4 showing the foot valve mechanism.

FIG. 4 depicts a version of an embodiment of the pump assembly 1 to be installed in a pump well 50, itself being suspended from the roof of a storage tank. FIG. 4A is an enlarged sectional view of the structure taken from FIG. 4. The pump rests on its seal seat ring adapter 1*a*, that engages with a support ring 52*a*, that is a part of a foot valve assembly 52. The foot valve assembly 52 is affixed to the bottom of the pump well 50 by welding at locations 67 such that the pump suction depicted in FIG. 1A is suspended above the tank bottom allowing cryogenic fluid contained in the tank to enter the pump.

When the pump is fully engaged with the foot valve support ring 52*a*, the seal seat ring adapter 1*a* depresses the foot valve closure plate 60, causing the valve to be held open. This is because springs 59 are biased between the support ring 52*a* and the supports 58 such that they bias the foot valve closure plate 60 in a closed position. When the pump assembly 1 is pulled upward within the pump well 50 the supports 58 and foot valve closure plate 60 is moved upwards and seals against the support ring 52*a* or any other suitable structure configured to create a cryogenic seal.

In mobile applications where the pump assembly 1 in its seat is required to operate while being subject to vertical, horizontal, and rolling motions such as may be experienced in a tank within a shipping vessel, or railroad tender car, it is necessary to secure the unit from being disadvantageously dislodged from its position. In such instances, a compressive load is applied to the upper motor plate 43 by means of a strut, known as a lift shaft 53. It will be apparent that in certain circumstances, the lift shaft may be used to extract the pump 2 from the pump well 50. In certain instances it may be convenient to divide the lift shaft into sections each coupled one to another, where the depth of the pump well 50 makes retrieval of the pump 1 inconvenient.

The upper end of the pump well may be closed by a headplate 54 through which passes a jack shaft 55, which engages a jack nut 56. The top of the jack shaft 55 and the jack nut 56 are accessed by removing a rain cover 57 which prevents the ingress of air or water or tank contents into or from the pump well 50, when rain cap is installed. With the rain cover 57 removed, a special wrench or crank may be engaged to the jack nut 56, and when the wrench is rotated, the jack shaft 55 is lifted, raising the pump assembly 1 from the support ring 52*a*, permitting the foot valve closure plate 60 to close, thereby isolating contents of the pump well 50 from the storage tank.

The rain cover 57 may then later be reinstalled, resealing the pump well 50. The contents of the pump well 50 may then be expelled by filling the pump well 50 with nitrogen gas at a suitable pressure in a manner known to those skilled in the art. The nitrogen gas may then be safely released to atmosphere, leaving the pump well 50 in a non-hazardous inert condition. The expelled fluid cannot return to the pump well 50 because the foot valve closure plate 60 permits only flow out but not in when the valve is closed.

Figure 5:
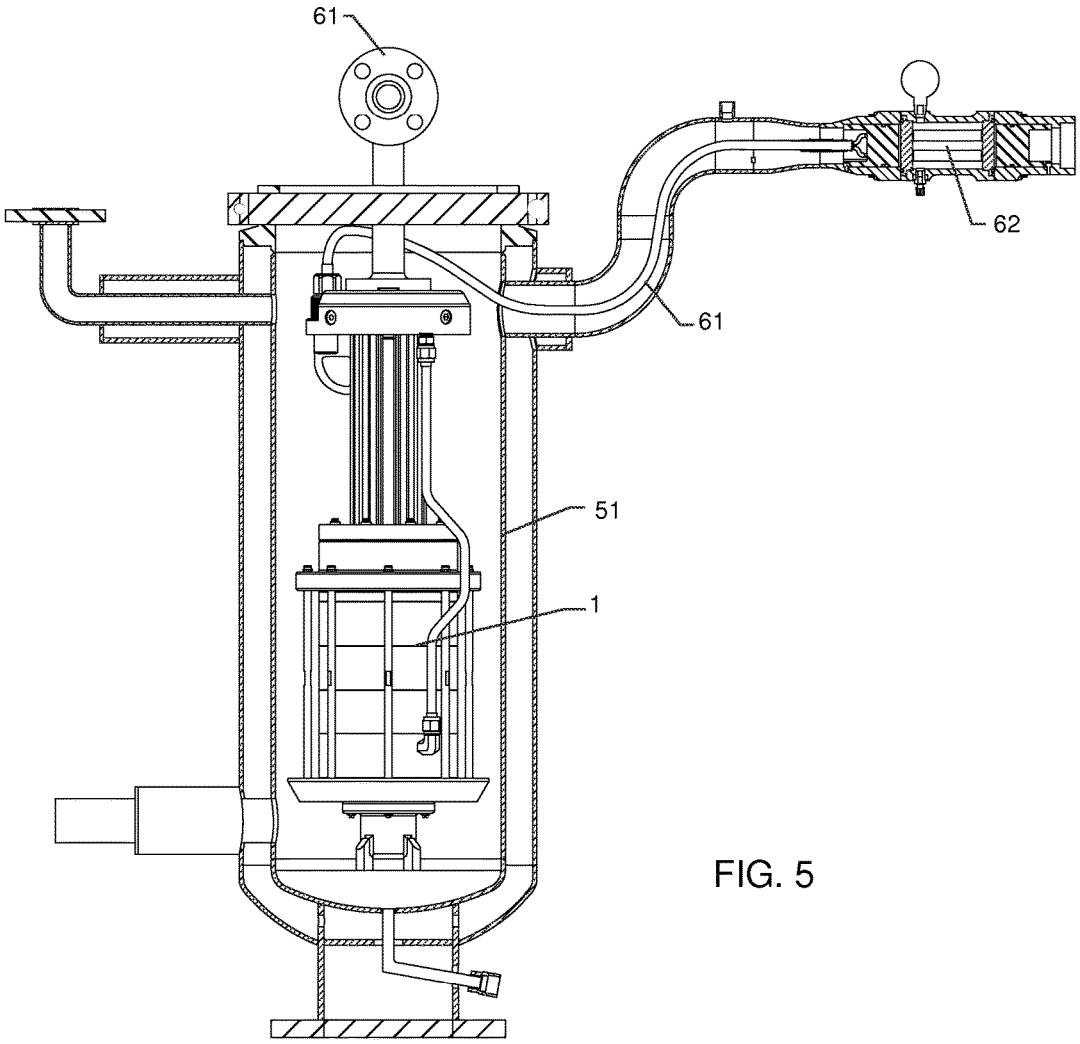
FIG. 5 is a sectional view of another embodiment of a cryogenic pump assembly installed inside a sump or suction vessel.

FIG. 5 is a sectional view of another embodiments of a cryogenic pump assembly 1 installed inside a tank 51. At the top of the tank 51 is an outlet port 61 that contains the high pressure cryogenic fluid. The operation of the pump is enabled by electric power supplied from an external power supply system through power cables 61 that are configured to pass through a specially design cryogenic electrical connection port 62.

The present invention is designed to submerge the permanent magnet motor within the cryogenic fluid. This allows a means of electrically driving the pumps at speeds not commonly applied to such pumps. The submerged permanent magnet motor includes an insulation system suitable for long term immersion in cryogenic fluid, such as light hydrocarbon and other electrically non-conducting and non-corrosive fluids.

The submerged permanent magnet motor has a unique small diameter to length ratio and overall profile designed to minimize rotative viscous friction losses while rotating in the cryogenic fluids. Such geometry is not attainable in induction motors for reasons well known to those skilled in the art. The submerged permanent magnet motor with a multistage pump uniquely embodies a rotating element having a very low rotating mass for the purpose of elevating the critical speed, allowing for operation over a wide operating speed thereby extending the controllable range of pumping flow and pressure.

Although several embodiments have been described in detail for purposes of illustration, various modifications may be made to each without departing from the scope and spirit of the invention. Accordingly, the invention is not to be limited, except as by the appended claims.

NUMERALS

1 cyrogenic pump assembly
1*a* seal seat ring adapter
1*f* coolant supply tube
1*e* motor electrical connection
2 pump suction inlet
3 extension
4 suction inducer
5 vanes/blades, suction inducer
6 inducer hub
7 first-stage impeller
8 impeller hub
8*a* impeller vanes
8*b* tapered bore, impeller hub
9 pump shaft
9*a* tapered collet
10 shroud, impeller
10*a* vane edges
13 impeller discharge
14 annular space
15 wearing ring
16 radial style diffuser
17 diffuser vanes, radial-style
18 return zone
19 channels
20 second stage impeller inlet
21 return zone
22 discharge collector
23 permanent magnet submerged motor assy
24 discharge tubes
25 discharge manifold
26 discharge nozzles
27 zone
28 thrust balance mechanism
28*a* balance drum
28*b* stationary sleeve
28*c* zone
28*d* annular gap
28*e* throttle gap
28*g* seal surface, balance drum
28*h* face, baffle plate
29 wave spring
30 tapered collet
31 motor cavity zone
32 baffle plate
34 permanent magnet motor/rotor
35*a* lower ball bearing, motor
35*b* upper ball bearing, motor
36 stator
37 lower bearing housing
37*b* shoulder, lower bearing housing
38 upper bearing housing
38*a* motor top plate

38*b* shoulder, upper bearing housing
39 motor casing
40 lamination stack
41 shoulder feature
41*a* shoulder feature, lower bearing housing
41*b* shoulder features, upper bearing housing
42 lower motor plate
43 upper motor plate/discharge manifold
44 pump assembly
45 tie rods
45*b* nuts
46 pump housing
47 galleys
48 central chamber
49 discharge spool
49*a* discharge port
50 pump well
51 tank
52 foot valve assembly
52*a* support ring, foot valve
53 lift shaft
54 headplate
55 jack shaft
56 jack nut
57 rain cover
58 supports
59 springs
60 foot valve closure plate
61 rotor diameter
62 rotor height
63 first diameter, inducer hub
64 second diameter, inducer hub
65 third diameter, inducer hub
66 common outermost diameter, inducer vanes/blades
67 welding location

What is claimed is:

1. A cryogenic submerged multi-stage pump assembly, comprising:

a vertically oriented pump shaft wherein the pump shaft comprises a magnetic stainless steel portion;

an electrical motor comprising a rotor attached to the pump shaft and a stator disposed about the rotor, wherein the electrical motor comprises a permanent magnet electrical motor, wherein the rotor comprises four magnetic poles and wherein the four magnetic poles are secured to the magnetic stainless steel portion by magnetic force;

a first-stage impeller assembly comprising a first impeller attached to the pump shaft, the first impeller configured to move a cryogenic fluid from a first impeller inlet to a first impeller outlet when the pump shaft is rotated by the electric motor, and a first impeller housing disposed about the first impeller and configured to channel the cryogenic fluid once it exits the first impeller outlet; and a second-stage impeller assembly comprising a second impeller attached to the pump shaft, the second impeller configured to move the cryogenic fluid from the first impeller housing to a second impeller inlet and then to a second impeller outlet when the pump shaft is rotated by the electric motor, and a second impeller housing disposed about the second impeller and configured to channel the cryogenic fluid once it exits the second impeller outlet to a discharge tube or discharge outlet;

wherein the first-stage impeller assembly is disposed below the second-stage impeller assembly, and where the second-stage impeller assembly is disposed below the permanent magnet electrical motor.

2. The assembly of claim 1, wherein the four magnetic poles comprise samarium cobalt.

3. The assembly of claim 1, wherein the electrical motor is powered and controlled by a remote-mounted inverter or remote-mounted variable frequency drive, either of which is configured to convert incoming three-phase 50 or 60 Hz power to a voltage level from 380 to 690 volts at an output frequency which is 10-100% of 240 Hz.

4. The assembly of claim 1, wherein the electrical motor is configured to operate above 4000 rpm and up to 10,000 rpm.

5. The assembly of claim 1, wherein the electrical motor is configured to operate above 5000 rpm and up to 10,000 rpm.

6. The assembly of claim 1, wherein the electrical motor is configured to operate above 6000 rpm and up to 10,000 rpm.

7. The assembly of claim 1, wherein the electrical motor is configured to operate above 7000 rpm and up to 10,000 rpm.

8. The assembly of claim 1, wherein the rotor has a height which is at least 4 times and up to 5 times a diameter of the rotor.

9. The assembly of claim 1, wherein the rotor has a height which is 5 times a diameter of the rotor.

10. The assembly of claim 1, including a suction inducer attached to the pump shaft and disposed below the first-stage impeller assembly, the suction inducer comprising an inducer hub with a plurality of helically extending blades, wherein the inducer hub comprises an outside surface having a first diameter at a bottom section of the inducer hub, a second diameter in a middle section of the inducer hub, and a third diameter at a top section of the inducer hub, where the second diameter is larger than the first and third diameters.

11. The assembly of claim 10, wherein the plurality of helically extending blades extend to a common outermost diameter.

12. The assembly of claim 10, wherein an inner surface of the first impeller at the first impeller inlet has a diameter similar to the third diameter of the inducer hub.

13. The assembly of claim 10, wherein there is not a static diffuser along the cryogenic fluid flow path after the suction inducer and ahead of the first impeller.

14. The assembly of claim 10, wherein the plurality of helically extending blades are disposed at or below the middle section of the inducer hub wherein there are no plurality of helically extending blades near the top section of the inducer hub.

15. The assembly of claim 1, wherein the pump shaft comprises a keyless pump shaft.

16. The assembly of claim 15, wherein the first impeller and second impeller are both attached to the pump shaft by a tapered collet, the tapered collet attached to the pump shaft by an interference fit.

17. The assembly of claim 16, wherein the tapered collet comprises a frustoconical outer surface which is larger in diameter closer to the bottom of the tapered collet when installed on the pump shaft.

18. The assembly of claim 17, wherein the first and second impellers have a frustoconical inner surface configured to match the frustoconical outer surface of the tapered collet.

19. The assembly of claim 1, including a motor casing disposed about the stator.

20. The assembly of claim 19, wherein the motor casing comprises an upper bearing housing at a top of the motor casing and a lower bearing housing at a bottom of the housing, wherein each bearing housing is configured to retain a ball bearing assembly.

21. The assembly of claim 1, including a plurality of tie rods configured to fixture the first-stage and second-stage impeller assemblies in a fixed relationship.

22. The assembly of claim 1, including a pump housing disposed about the first-stage and second-stage impeller assemblies, the pump housing configured to fixture the first-stage and second-stage impeller assemblies in a fixed relationship.

23. The assembly of claim 1, wherein the electric motor comprises an upper ball bearing assembly disposed near or at a top portion of the electric motor, and including a coolant supply tube in fluidic communication with the first-stage impeller assembly and the upper ball bearing assembly.

24. The assembly of claim 1, wherein the rotor comprises a circumferential non-magnetic sleeve disposed over the four magnetic poles.

25. The assembly of claim 1, wherein the rotor has a height of at least 3 times and up to 5 times a diameter of the rotor.

26. The assembly of claim 1, wherein the pump shaft is a keyless pump shaft.

27. The assembly of claim 26, wherein the first impeller and second impeller are both attached to the pump shaft by a respective tapered collet, each tapered collet attached to the pump shaft by a respective interference fit.

28. The assembly of claim 27, wherein each tapered collet has a frustoconical outer surface which is larger in diameter closer to the bottom of the tapered collet when installed on the pump shaft, wherein the first and second impellers may have a frustoconical inner surface configured to match the frustoconical outer surface of their respective tapered collet.

29. A cryogenic submerged multi-stage pump assembly, comprising:

a vertically oriented keyless pump shaft wherein the pump shaft comprises a magnetic stainless steel portion;

an electrical motor comprising a rotor attached to the pump shaft and a stator disposed about the rotor, wherein the electrical motor comprises a permanent magnet electrical motor, wherein the electrical motor is configured to operate above 7000 rpm and up to 10,000 rpm, wherein the rotor comprises only four magnetic poles and wherein the four magnetic poles comprise samarium cobalt, wherein the four magnetic poles are secured to the magnetic stainless steel portion by magnetic force;

a first-stage impeller assembly comprising a first impeller attached to the pump shaft, the first impeller configured to move a cryogenic fluid from a first impeller inlet to a first impeller outlet when the pump shaft is rotated by the electric motor, and a first impeller housing disposed about the first impeller and configured to channel the cryogenic fluid once it exits the first impeller outlet;

a second-stage impeller assembly comprising a second impeller attached to the pump shaft, the second impeller configured to move the cryogenic fluid from the first impeller housing to a second impeller inlet and then to a second impeller outlet when the pump shaft is rotated by the electric motor, and a second impeller housing disposed about the second impeller and configured to channel the cryogenic fluid once it exits the second impeller outlet to a discharge tube or discharge outlet;

wherein the first-stage impeller assembly is disposed below the second-stage impeller assembly, and where the second-stage impeller assembly is disposed below the permanent magnet electrical motor;

wherein the pump shaft is a continuous and uninterrupted pump shaft made from a single part.

30. The assembly of claim 29, wherein the rotor has a height of at least 3 times and up to 5 times a diameter of the rotor.

31. A cryogenic submerged multi-stage pump assembly, comprising:

a vertically oriented pump shaft wherein the pump shaft comprises a magnetic stainless steel portion;

an electrical motor comprising a rotor attached to the pump shaft and a stator disposed about the rotor, wherein the electrical motor comprises a permanent magnet electrical motor, wherein the rotor comprises only four magnetic poles and wherein the four magnetic poles are secured to the magnetic stainless steel portion by magnetic force;

a first-stage impeller assembly comprising a first impeller attached to the pump shaft, the first impeller configured to move a cryogenic fluid from a first impeller inlet to a first impeller outlet when the pump shaft is rotated by the electric motor, and a first impeller housing disposed about the first impeller and configured to channel the cryogenic fluid once it exits the first impeller outlet;

a second-stage impeller assembly comprising a second impeller attached to the pump shaft, the second impeller configured to move the cryogenic fluid from the first impeller housing to a second impeller inlet and then to a second impeller outlet when the pump shaft is rotated by the electric motor, and a second impeller housing disposed about the second impeller and configured to channel the cryogenic fluid once it exits the second impeller outlet to a discharge tube or discharge outlet; and a suction inducer attached to the pump shaft, the suction inducer comprising an inducer hub with a plurality of helically extending blades, wherein the inducer hub comprises an outside surface having a first diameter at a bottom section of the inducer hub, a second diameter in a middle section of the inducer hub, and a third diameter at a top section of the inducer hub, where the second diameter is larger than the first and third diameters, and wherein an inner surface of the first impeller at the first impeller inlet has a diameter approximately similar to the third diameter of the inducer hub;

wherein the suction inducer is disposed below the first-stage impeller assembly and attached to the pump shaft, where the first-stage impeller assembly is disposed below the second-stage impeller assembly, and where the second-stage impeller assembly is disposed below the permanent magnet electrical motor;

wherein the pump shaft is a continuous and uninterrupted pump shaft made from a single part.

32. The assembly of claim 31, wherein the rotor has a height of at least 3 times and up to 5 times a diameter of the rotor.

* * * * *